US005099758A

United States Patent [19]

Hassler et al.

[11] Patent Number: 5,099,758

[45] Date of Patent: Mar. 31, 1992

[54] APPARATUS FOR APPLYING A FLOWABLE MEDIUM TO A SURFACE, ESPECIALLY A WEB, ROLL OR THE LIKE

[75] Inventors: Heinz Hassler; Michael Warmuth, both of Klagenfurt, Austria; Albert Bellina, Maracay, Venezuela

[73] Assignee: HWB Maschinenbau Gesellschaft m.b.h., Klagenfurt, Austria

[21] Appl. No.: 503,617

[22] Filed: Apr. 2, 1990

[30] Foreign Application Priority Data

Mar. 31, 1989 [AT] Austria ..... A759/89

[51] Int. Cl.[5] ..... B41L 13/00

[52] U.S. Cl. ..... 101/120; 101/115; 101/424; 118/216; 118/217; 239/549

[58] Field of Search ..... 101/115, 119, 120, 124, 101/423, 424; 118/213, 216, 218, 219, 223, 255, 406; 222/144; 239/549

[56] References Cited

U.S. PATENT DOCUMENTS

| | | | |
|---|---|---|---|
| 3,735,730 | 5/1973 | Mitter | 101/119 X |
| 3,823,409 | 7/1974 | Carrell | 346/140 PD |
| 3,862,617 | 1/1975 | Prestegaard | 118/213 |
| 3,952,650 | 4/1976 | Lotte | 101/120 |
| 4,014,289 | 3/1977 | Zimmer | 101/119 X |
| 4,453,462 | 6/1984 | Mitter | 101/124 |
| 4,709,631 | 12/1987 | Davey et al. | 101/129 |
| 4,714,936 | 12/1987 | Helinski et al. | 346/140 R |

*Primary Examiner*—Edgar S. Burr
*Assistant Examiner*—Christopher A. Bennett
*Attorney, Agent, or Firm*—Herbert Dubno

[57] ABSTRACT

In a screen printing apparatus an applicator body is rotatable about its axis to selectively bring one of a plurality of medium supply ducts into active position so that it can deliver the color medium to the substrate. The applicator roller or blade and a strip defining the applicator compartment are provided on the rotatable body for each set of orifices and each distribution duct so that these elements need not be cleaned for color changeover since they remain associated with the color when the applicator is rotated.

16 Claims, 10 Drawing Sheets

APPARATUS FOR APPLYING A FLOWABLE MEDIUM TO A SURFACE, ESPECIALLY A WEB, ROLL OR THE LIKE

FIELD OF THE INVENTION

Our present invention relates to an apparatus for applying a flowable substance or medium to a surface which can be a flat surface, a web of flexible material such as a foil of plastic, a web of paper or a web of fabric, to a roll or the like, generally utilizing a screen as a template or platen for the application of the flowable medium, which can be an ink, a dyestuff or other coloring agent. More particularly the invention relates to a screen printing apparatus of this type utilizing a flat or curved screen and a system in which the flowable medium to be applied to the receiving surface, i.e. the substrate is doctored or wiped through the screen onto this surface or is forced through the screen onto the surface by a roll.

BACKGROUND OF THE INVENTION

Screen-printing apparatus in which a body is formed with a distribution duct for a flowable medium, which can be a viscous medium such as an ink, a dyestuff or another flowable coloring substance, effects relative movement of the surface or substrate to be printed and a printing station at which the body provided with this duct is located. A screen defiring the pattern or template to be printed onto the substrate likewise can be moved across this body which can have a multiplicity of openings juxtaposed with the surface and, of course, the portion of the screen interposed between this body and the surface.

The flowable medium can be wiped through the screen, where the openings of the latter are not obstructed by a patterning, or the flowable medium can be forced through the screen by a roller. The wiping action can be effected by a blade which generally is flexible and extends the full width of the region to which the flowable medium is to be applied and can be located downstream of the openings formed in the body and connected to the duct which feed the flowable medium to the screen. A bank of this material can accumulate upstream of the doctor blade or wiper or the applicator roller.

In practice it is desirable to be able, with such a screen printing apparatus, to effect a rapid color change, i.e. minimize the downtime or standstill of the apparatus which has hitherto been necessary to effect a color change, i.e. a changeover between the application of one flowable medium, e.g. one color of such a medium, to a different flowable medium, e.g. a flowable medium of a different color.

In most prior art screen printing machines operating in accordance with the principles described it has been necessary for such a color change to shut down the entire machine and to replace the entire applicator unit, for example, the applicator tube and applicator roller and to remove the screen, clean it and return it to the machine. The apparatus downtime as a result is relatively long.

In the European Patent Document EP-A2 277 481, it is known to effect the cleaning of the machine without requiring its disassembly. For this purpose, the medium distribution tube is supplied with flushing liquid which can be a solvent for the previously used flowable medium and which serves, when the screen rotates past this applicator, to clean the internal surfaces of the screen. A suction device is provided in addition to draw off the flushing liquid which is used. A disadvantage of this type of machine is that during the cleaning only the inner surface of the template or screen can be cleaned and that substantially all of the medium which may remain in the medium distribution tube must be forced through the latter and onto the screen or template or pattern and then flushed therefrom by the flushing liquid.

As a consequence, relatively large volumes of the flushing liquid must be used and the flushing operation is time consuming.

Furthermore, a uniform cleaning of the pattern or screen, because of the spacing and location of the suction openings is not always possible.

Another apparatus for this purpose is described in European patent publication EP - A1 91 716. This system utilizes two applicator tubes in a single applicator body which extend over the entire work width of the machine to provide a uniform application of the medium. The two medium-distribution tubes open into a single gap and are connected to a single medium-supply vessel. Since the two medium tubes are traversed in opposite directions by the respective portions of the medium the distribution of the medium over the width of application can be relatively uniform.

Swiss Patent 556,236 describes a rotatable doctor-blade casing with only a single applicator tube. After rotation of the doctor blade casing, the residual medium therein can be permitted to flow more or less completely back into the medium supply vessel.

Austrian Patent 360 950 describes an apparatus enabling the applicator width of a screen printing machine to be adjusted by adjustable lateral members. This publication also describes the use of level sensors which can control or monitor the depth of the bank of material immediately upstream of the location at which the flowable medium is transferred to the substrate.

OBJECTS OF THE INVENTION

It is the principal object of the present invention to provide an improved screen printing apparatus whereby disadvantages of the prior art systems, especially the prior art apparatuses described, can be avoided.

A more specific object of the invention is to provide a machine for the purposes described in which color change can be effected more simply, more rapidly and more efficiently than has been possible heretofore.

Another object of the invention is to provide an apparatus for applying selectively a plurality of fluid mediums to a surface.

It is also an object of the invention to provide an improved apparatus for the cleaning of a screen or template which is compatible with a color change in accordance with the invention and which <:an effect, as desired, cleaning of both inner and outer surfaces of a screen or pattern of the machine.

SUMMARY OF THE INVENTION

These objects and others which will become apparent hereinafter are attained, in accordance with the invention in an apparatus for applying a flowable medium to a receiving surface, namely, a planar substrate, a web or a roll, e.g. for the screen printing transfer of a pattern to this surface through a screen template or pattern and wherein the flowable medium is preferably an ink, dye or like coloring substance, which comprises:

means for relatively displacing the receiving surface and a station at which the flowable medium is applied to the surface; and an elongated applicator body at the station having an axis parallel to the surface and formed with a plurality of medium-distribution ducts connectable to respective medium-supply vessels containing different flowable mediums applicable to the surface, and respective outlet opening connected to the ducts and extending along the body, the outlet openings connected to each duct being angularly spaced about the axis from the openings connected to the others of the ducts, and means for mounting the body for rotation about the axis for selectively positioning the openings connected to a respective one of the ducts in juxtaposition with the surface so that only a flowable medium from the one of the ducts is applied to the surface and the different flowable mediums can be selectively applied to the surface by rotation of the body about the axis.

The objects of the invention are therefore attained by providing the body at the screen printing station so that it has a plurality of medium distribution tubes or ducts, each with its own set or row of outlet openings connected with that duct and such that the applicator body is rotatable about its axis. This allows a plurality of flowable mediums of different color, for example, to be fed respectively to the individual distribution ducts so that, depending upon the outlet openings juxtaposed with the substrate as selected by rotation of the body, one or another of the flowable media or color substances can be applied to the substrate. One need only rotate the doctoring device which can include the doctor blades or the applicator roller to select which of the colors is to be applied and need only rotate the body to switch over from one color to another.

To provide an especially uniform application of each flowable medium, the applicator body is preferably provided at a downstream location thereon with respect to each roll of openings or array of opening slits, with a doctor blade, hereinafter referred to as an applicator blade, and which serves to press the flowable medium through the screen onto the substrate. According to this aspect of the invention, the flexible doctor blade of each set of openings is braced by a support body or element, preferably a support element which can be dilated adjustably by varying its pressure and/or volume and which extends parallel to the applicator blade downstream thereof. By controllably expanding or contracting this element, i.e. by controlling the pressure of volume thereof, it is possible to adjust the force with which the applicator blade presses the flowable medium through the screen.

Advantageously at an upstream side of the openings of each duct, a strip is provided to define with the applicator blade, an applicator compartment into which the flowable medium is fed by the openings connected to the respective duct.

This compartment is bounded at its ends by lateral wall means which define the length of the compartment and thus the extent to which it stretches across the surface to which the flowable medium is to be applied and consequently the application width.

The openings associated with each of the medium distribution ducts, therefore, open into the respective applicator compartments.

The dilatable support element against which the applicator blade lies uniformly over the full application width can be varied as to pressure or volume and the form of the blade can be modified to suit any special requirements with respect to the nature of the application of the flowable medium. By the use of the strip and lateral wall means, as described, to define a compartment, the formation of a spray mist of the flowable medium and its release at the machine into the environment can be prevented.

In accordance with another embodiment of the invention, each of the ducts and the respective openings is provided with a respective applicator roll whose ends can be shaped to be received in respective roll guides so that each applicator roll, when the body is rotated to select the particular liquid medium, is automatically positioned to be brought into play and press the particular flowable medium through the screen or template onto the surface. Each roller can extend substantially the full applicator width. These applicator rolls fulfill substantially the same purpose as the applicator blades.

When the applicator blade is provided with a plurality of such medium-distribution ducts and, in addition, respective applicator blades and/ applicator rollers, for each medium to be applied to the substrate, a respective medium distribution duct and a correspondingly respective applicator blade or applicator roller can be provided on the body which is brought into action when the applicator body is rotated about its axis to position the respective applicator duct and its openings in the active position. Since each medium distribution duct, its openings, the applicator compartment associated therewith and the applicator blade or roller for that color of the medium to be applied is used only for that medium, cleaning of the applicator body, the blades or the rollers can be dispensed with upon a color change.

The apparatus of the invention ensures a uniform distribution of the applied quantity of each medium over the respective application width and thus can utilize a minimum of the medium to be applied in each case so that especially reproducible results are obtained.

For the application of flowable and especially viscous media to flat surfaces, the working width can be varied for each medium by varying the length of the respective compartment across the width of the surface to which the medium is applied. In all cases, however, the distribution of the medium over the respective working width should be as uniform as possible since upon such uniformity will depend the uniformity and quality of the coated web.

In screen printing, this uniformity of distribution can be ensured by dividing the flow to the screen over the length of the applicator body by providing for each medium distribution duct, a multiplicity of discharge openings spaced apart across the web and from which the medium can drip or flow as droplets onto the inner service of the patterning screen (see, for example, European patent document EP-A2 277 481). This requires that a bank or collection of the medium will be formed in the round screen that the medium will distribute itself uniformly in the bank and can be pressed through the rotating drum-like patterning screen by the respective doctor blade or applicator roller.

This process has been found to operate satisfactorily only when large quantities of a medium are to be applied. As the applied quantity becomes less, the volume of the bank of the material is likewise diminished and the bank of the medium upstream of the blade or roller tends to become nonuniform. When screen printing templates are used, the nonuniformity can result in accumulation of medium in those regions of the patterning screen which have fewer openings and in which there is no consumption of the medium.

There are systems which have, in the past, been provided so that the flow of the medium from the medium distribution duct is limited or terminated when, for example, upon standstill of the apparatus, no additional medium is to be applied to the substrate. On the other hand, the depth of the bank of material can increase and the quantity which is applied can be excessive when the apparatus is again brought into operation. This problem can occur even when, the operation is effected according to EP-A2 277 481, because substantial quantity of the medium can continue to flow even though the supply of the medium to the distribution duct is cut-off.

As a consequence, according to an aspect of the invention, the outlet openings can be provided in the form of spray nozzles which can be disposed in one or more rows and which preferably are provided upstream of the nozzle orifices thereof with pressure-actuated valves which close automatically when the supply pressure of the medium falls below a predetermined minimum pressure.

Because of the use of such spray nozzles or nozzle orifice outlets, i.e. orifices through which the medium can be sprayed and thereby distributed in air to reach the screen or substrate, no bank of the material need be provided and there need be no concern to maintain a uniform bank of the material.

In other words the distribution is here effected primarily by the spraying of the flowable medium onto or toward the substrate pressure actuated valves are provided upstream of the spray nozzles or orifices, they can automatically close when the supply pressure falls below the minimum pressure and thus the outflow of the medium can be simply terminated immediately by dropping of the supply pressure in the medium distribution duct.

The medium is normally—as in the prior art— supplied by a control device with a predetermined pressure or at a predetermined volume rate of flow to the medium distribution duct.

Advantageously, at least: one medium distribution duct is provided with a self priming reversible dyestuff pump with volumetric and or, pressure control.

It has been found to be advantageous, in addition, to provide means for cleaning the inner and outer surfaces of the patterning screen.

According to a feature of the invention, the internal cleaning of the screen can be effected by providing the applicator body with medium distribution duct which distributes to its outlet openings, e.g. spray nozzles or orifices, a cleaning medium, i.e. a solvent for a previously applied dyestuff or ink. The body can be formed, moreover, with a collecting passage which can receive the cleaning liquid, e.g. a solvent, after it has flushed the patterning screen.

In this configuration, no cleaning device need be provided in addition to the cleaning means provided in the applicator body. By contrast with the system of EP-A2 277 481, before a cleaning medium can be sprayed, the device must be emptied from the prior contents of a coloring medium in a medium distribution duct. With the system of the invention, since a separate duct can be provided on applicator body and the latter rotated to bring the cleaning duct into an appropriate position for cleaning, the cleaning operation can be effected more rapidly.

It is advantageous, further, to provide on the applicator body a cleaning blade which can wipe the cleaning liquid from the screen and thereby eliminate both residues of the flushing liquid and of any dyestuff so that these residues are readily delivered to the passage through which the flushing liquid and residues are removed. A dyestuff pump can be used to draw off residues of the dyestuff by reversing the operation thereof.

According to a further feature of the invention, the cleaning of the screen pattern is effected along its internal and external surfaces by means independent of the cleaning medium distribution to be and the take up passage for the spent cleaning medium. Such cleaning means can be provided to flush the inner and outer surfaces both during an application of a fluid medium to the substrate as well as during an interruption of application of the fluid medium.

The internal and external cleaning referred to here can be effected at a minimum cost and without interruption of operations since the screen pattern need not be removed from the apparatus. A cleaning device at least for internal cleaning which is effective during application can also be incorporated in the applicator body as described so that it is effective when a fluid medium applicator duct is juxtaposed with the substrate.

A separate cleaning device according to the invention can engage the screen on one side to take up the cleaning liquid and on an opposite side to dispense a cleaning liquid directly opposite one another. However, the cleaning liquid take up device, associated with a squeegee or wiper, can also be located downstream of the supply device for the cleaning liquid in the direction of rotation of the drum type screen pattern.

It has been found to be advantageous to make the applicator width and, advantageously, also the effective width of the cleaning device adjustable. In the latter case, the cleaning device can make use of a preformed strip which can be replaceably mounted on the apparatus and via which the supplied cleaning medium and the entrained dyestuff residues can be removed. Level regulation of the bank of the fluid medium to be applied to the substrate can be effected in accordance with Austrian patent 360 950 utilizing a level detector fixed at the exterior. However, this type of control device means that the level which can vary across relatively large working widths is monitored at and controlled from only one side. It is possible to truly uniformly apply the medium over the full working width.

To avoid this drawback, we can provide, in accordance with another feature of the invention a plurality of level detectors which are adjustably spaced apart across the full working width of the machine.

The depths of the bank of the flowable medium in respective regions can be fed to evaluation circuitry which can control the feed of the flowable medium to maintain uniformity of application.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1A:
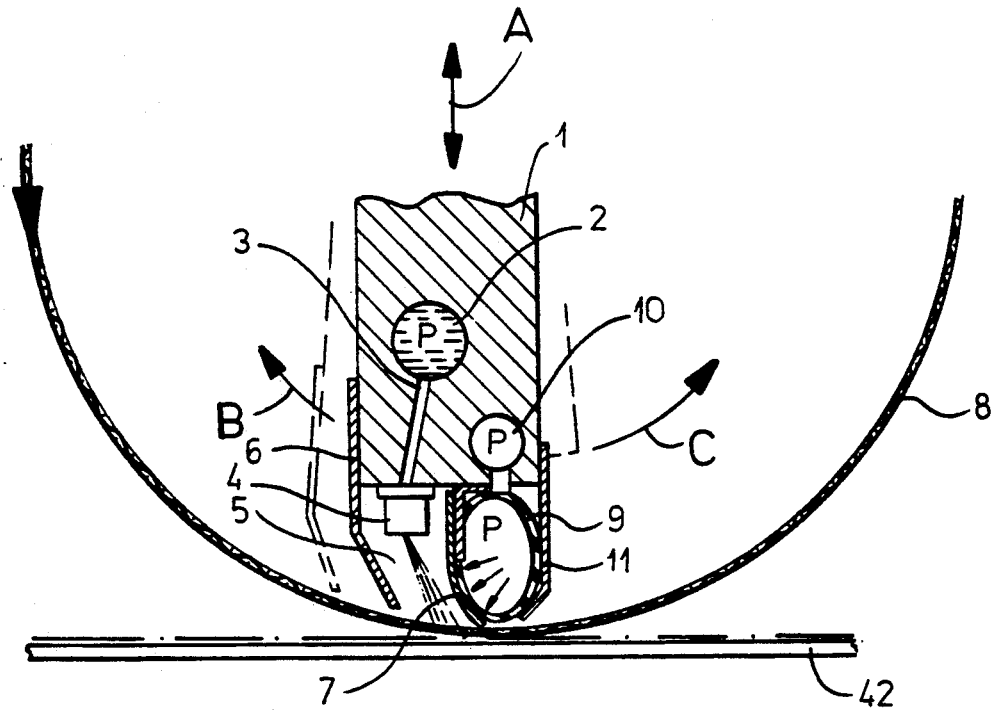
FIG. 1*a* is a cross sectional view of an applicator using spray nozzles.

FIGS. 1*a* and 1*b* and 2*a* and 2*b* are provided to illustrate principles which are used in the system of the invention more fully described in connection with FIGS. 3*a* through FIG. 10.

As can be seen from FIGS. 1*a* and 1*b* and 2*a*, 2*b*, an apparatus for applying a liquid medium to a substrate, such as a screen printing apparatus, can have an applicator body 1 extending the full width of the fabric web 42 to be printed above a table along which this web is displaced and which has not been illustrated in detail.

The applicator body 1 is, in these FIGS., shown to have only a single medium distribution duct 2. The medium distribution duct 2 is connected via passages 3 with a plurality of spray nozzles 4 spaced apart along the body and, as will be discussed below, the spray nozzles 4 when applied in the embodiment of FIGS. 3*a*, 3*b*, for example, can receive pressure actuated valves 4*a* which automatically close off the outlet orifices of the respective nozzles when the pressure of the medium supplied to the respective medium duct falls below a predetermined value.

Figure 1B:
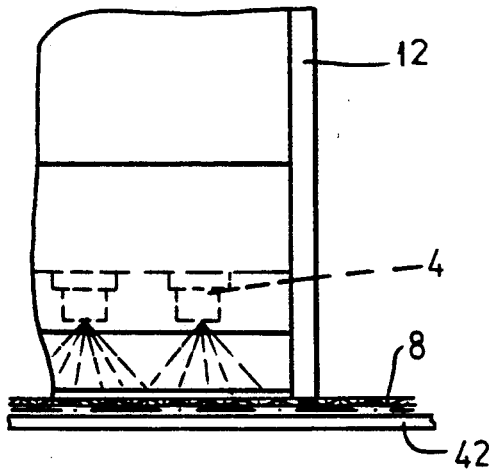
FIG. 1*b* is an elevational view of a portion of this applicator in a plane perpendicular to the plane of the section of FIG. 1*a*.
Figure 2A:
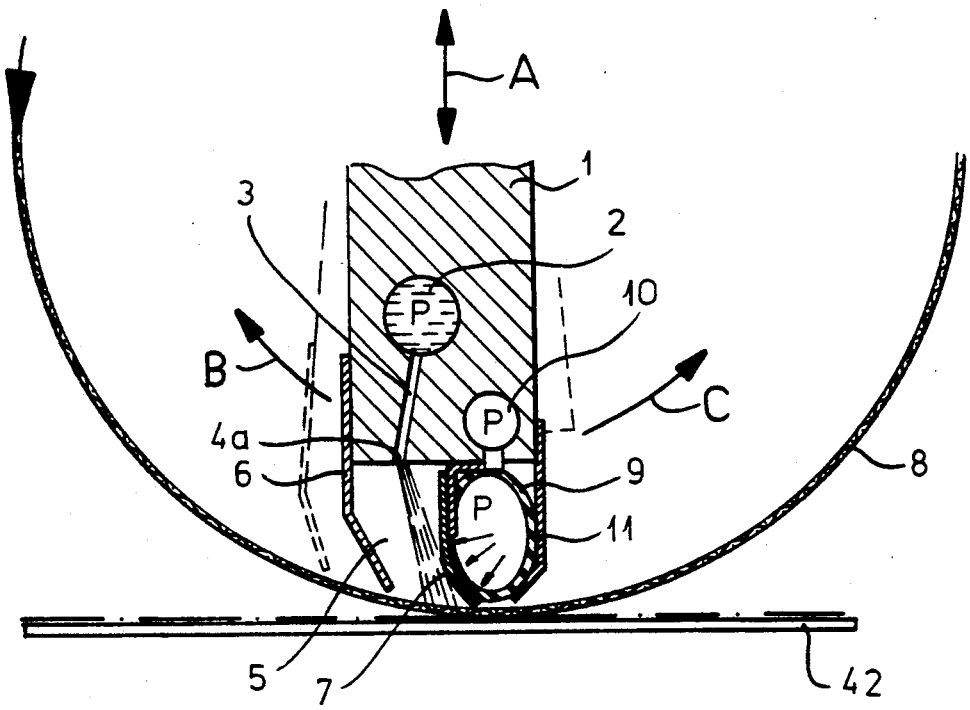
FIG. 2*a* is a view similar to FIG. 1 of an applicator width outlet orifice rather than the nozzles and check valves of the embodiment of FIG. 1*a* and FIG. 1*b*.
Figure 2B:
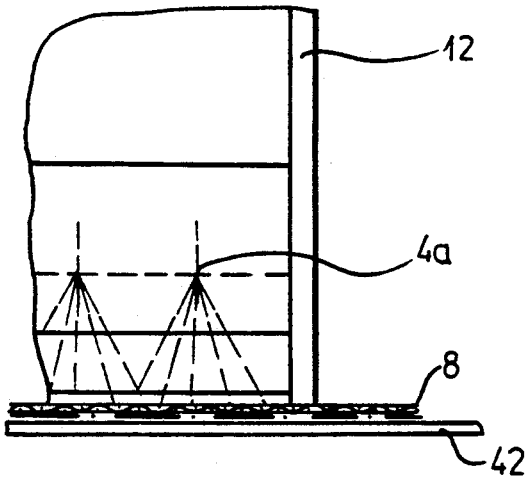
FIG. 2*b* is a view of the embodiment of FIG. 2*a* corresponding to the illustration of FIG. 1*b*.

In place of the nozzles 4 of FIGS. 1*a* and 1*b*, which distribute the flowable medium so that there is no significant build-up of a bank thereof, outlet orifices 4*a* can be provided (FIGS. 2*a* and 2*b*), which do not dispense highly dispensed sprays but eject streams or flows of the medium. The supply of the medium to the medium distribution duct generally derives from the exterior and has not been illustrated in these FIGS.

The medium from the spray nozzles 4 or nozzle orifices 4*a*, is trained on a screen pattern 8 which may be rotated about its axis as the web passes below the station at which the applicator body or bar is provided. The distribution of the medium in terms of the quantity delivered to each region is determined by the rate at which the respective spray is atomized in the spray nozzle 4 or distributed by the orifices 4*a* when the liquid medium in the applicator is pressurized. The pressure is normally adjustable.

To limit the dispersal of the medium, an applicator compartment 5 is provided and is defined by a strip 6, a doctor blade 7 and lateral wall members or strips 12 closing the ends of the compartment. Since the members 12 close the compartment at the ends of the body 1, the compartment 5 can be considered as substantially closed on all sides.

The doctor blade 7 serves not only to define a wall of the compartment 5 but primarily serves to press the flowable medium which has been applied to the screen template 8 through the latter and onto the web of material 42. In addition, the applicator blade serves to distribute the medium more uniformly, across the working width of the apparatus.

Since the applicator blade 7 rests with a defined pressure against the screen pattern 8, a bracing or support element or body 9 can be disposed between backing strip 11 and this flexible blade 7. The support element 9 can be supplied with a gaseous pressurizing medium via a passage 10 so that the pressure in the dilatable element 9 or its volume can be adjusted. Since the element 9 bears upon the flexible blade 7, the form and position of the latter and the manner in which it presses against the screen can be adjusted to the respective working conditions. Furthermore, the height of the body 1 as represented by the arrow A and its angular orientation with respect to the screen as represented by the arrow B and C can be varied. If desired, the support element 9 can be replaced and an element of nonuniform shape selected to vary the configuration of the pressure of the doctor blade 7 against the template can be substituted to further vary the pattern of application of the flowable medium.

Figure 3A:
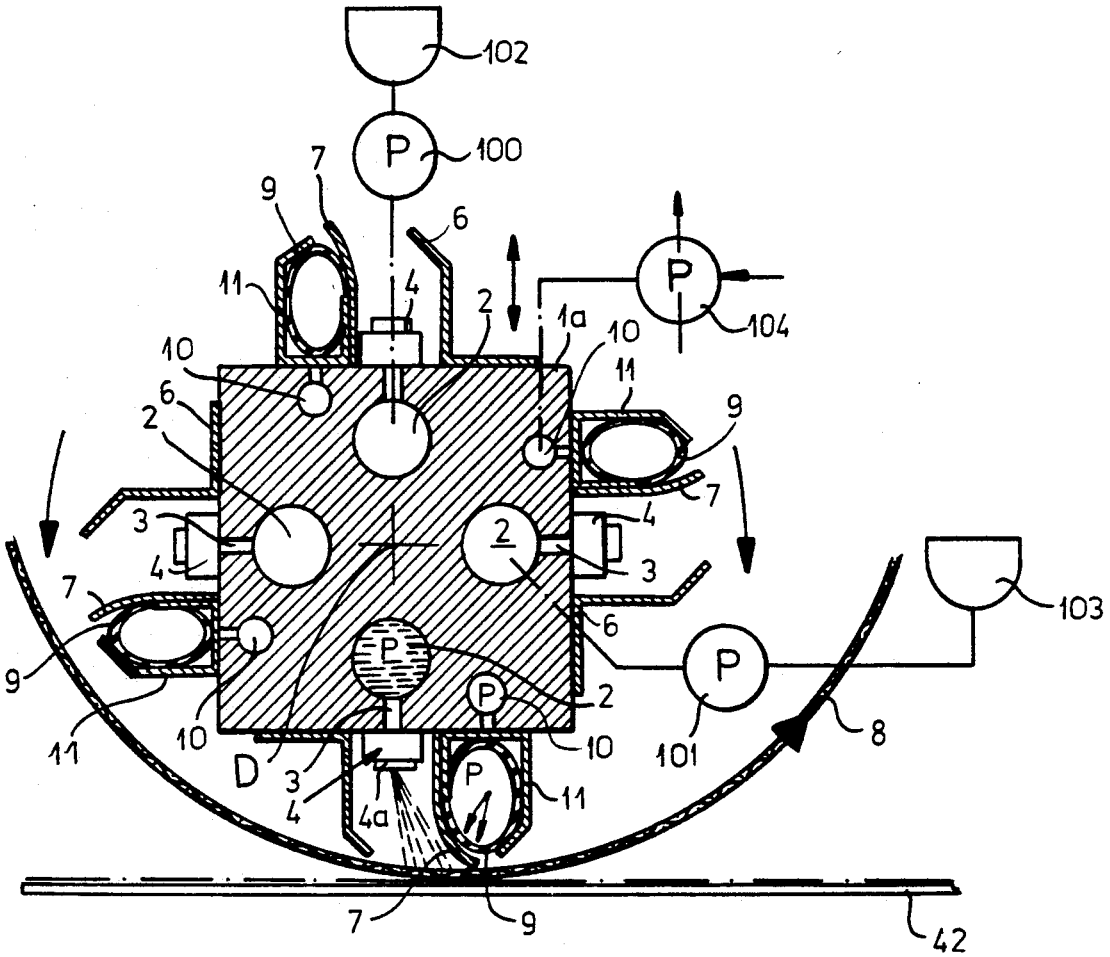
FIG. 3*a* is a cross sectional view generally similar to FIGS. 1*a* and 2*a* but illustrating an apparatus in accordance with the invention in which a plurality of fluid medium ducts are provided in a rotatable applioator body but wherein the ducts feed spray nozzles and respective pressure actuated valves as is the case in FIG. 1*a*.
Figure 3B:
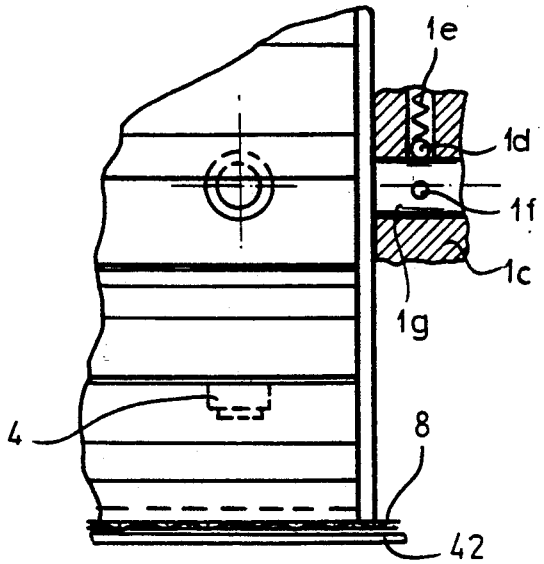
FIG. 3*b* is a fragmentary elevational view of the apparatus of the invention for rapid color change.

FIGS. 3*a* and 3*b* illustrate the principles of the invention and, it may be noted, that the applicator device 1 here comprises an applicator body 1*a* which is provided with a plurality of medium distribution ducts 2 which are angularly equispaced about an axis D of rotation of the body on a housing shown only in part at 1*c* in FIG. 3*b*.

For each of the medium distribution ducts 2, the parts 3 through 12 previously described in connection wit FIGS. 1*a*, 1*b*, 2*a*, 2*b* are also provided so that, in effect, four applicators for respective colors are provided on the one body 1*a*.

This embodiment allows a significant time saving to be obtained for color change. For example, for a color change it is only necessary to rotate the applicator body 1*a* through 90° about its axis D to bring a new blade 7, the associated applicator compartment 5, the nozzles 4 and the fluid medium duct 2 into juxtaposition with the substrate 42 at the applicator station.

To permit the rotation of the body and the indexing thereof in the new position, a shaft 1*g* can be rotated by.

for example, a hand wheel located on the outside of the machine, until an indexing ball 1*d* loaded by a spring 1*e* jumps into the respective recess 1*f* in the shaft 1*g*.

The spring 1*e* and the ball 1*d* thus forms a detailed arrangement for indexing the body 1*a* in its various angular positions for applying the respective colors.

The advantage of the applicator illustrated in FIGS. 3*a* and 3*b* is that a color change during production does not require any prolonged downtime of the machine, since mere rotation of the body 1*a* removes a previously used dye feed arrangement and brings a new one into action. The template can be cleaned in the manner which will be described in greater detail below.

Instead of spray nozzles 4 with pressure opening valves, conventional openings or orifices may be used to distribute the flowable medium from the respective duct.

The ducts themselves can be supplied by reversible pumps 100, 101, etc. supplied by respective vessels 102, 103 etc. The variable displacement pump 104 is an example of the type of pump which can supply the distendable elements 9 at variable pressure and for variable volume in the manner described.

Figure 4A:
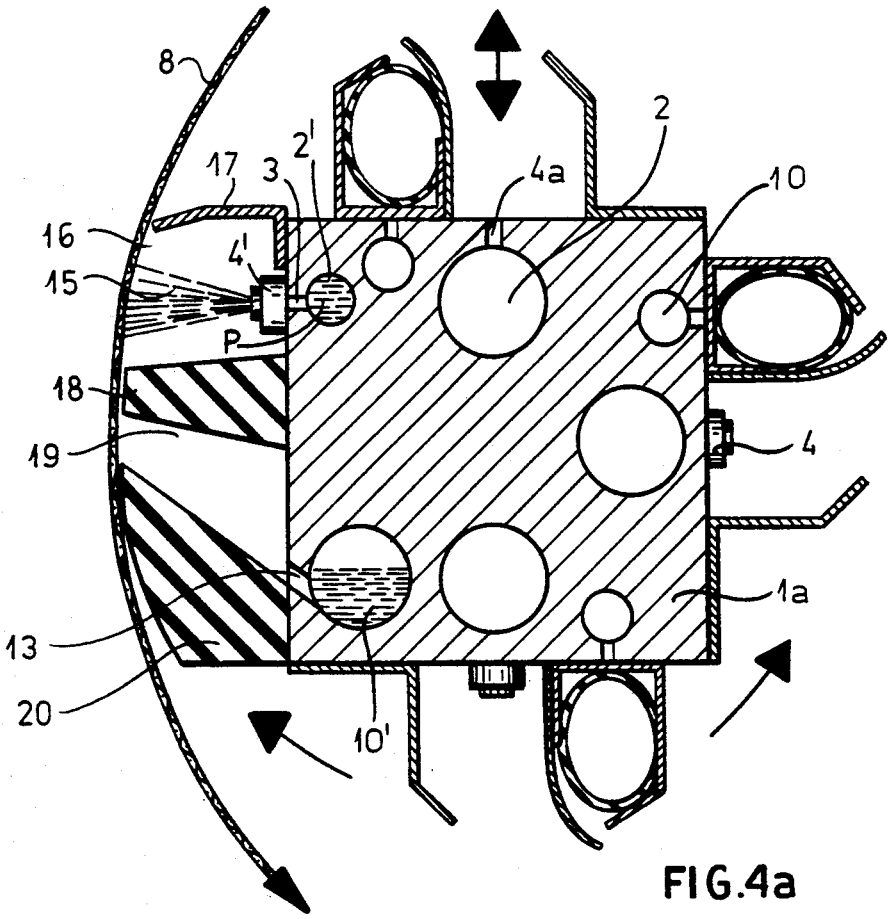
FIGS. 4*a* and 4*b* are views generally similar to the views of FIGS. 3*a* and 3*b* showing the applicator apparatus provided with a cleaning device.
Figure 4B:
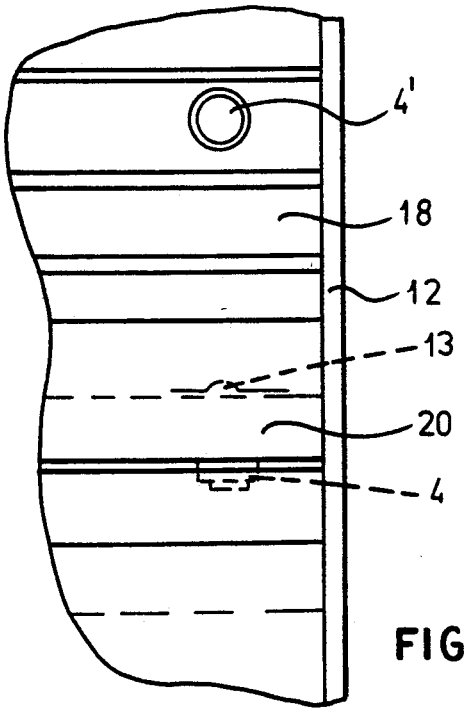

To reduce the time required for template cleaning, we can use a cleaning device integrated into the applicator body as has been illustrated in the embodiment of FIGS. 4*a* and 4*b*. The applicator body can be rotated to bring this cleaning device into juxtaposition with the inner wall of the applicator screen upstream of the location at which the medium is applied.

For this purpose, the applicator body is provided with a distribution duct 2' for a cleaning medium 15 which can be supplied by a reversible pump and is directed via passages 3 to spray nozzles 4' which flush the inner wall of the screen. Instead of spray nozzles other conventional nozzle bores or orifices or openings which otherwise deliver the cleaning liquid can be used. The pressure and/or volume of the cleaning medium 15 supplied from the exterior can be adjustable. The cleaning medium 15 is sprayed in an atomized spray uniformly over the interior surface of the pattern 8.

To limit the dispersal of the cleaning medium 15 to the cleaning compartment 16 and to prevent the spray from affecting other portions of the screen pattern space, the cleaning compartment 16 is defined between a strip 17 and a wiper 18 and is laterally defined by the strips 12. The strips 17 and 18 extend the full working width of the apparatus and the end strips 12 are affixed to the two ends of the applicator body 1*a*. A clearance is provided between the strip 18 and the template so that the cleaning medium 15 is forced past the strip 18 into a compartment 19 from which the cleaning medium is evacuated from the template. The suction passage 19 is bounded by the strip 18, the end strips 12 and a stripper or squeegee 20. The suction compartment 19 is connected by a passage 13 with a suction duct 10' of the body 1*a* which can be connected in turn to a reversible dye pump which in its suction mode, withdraws dyestuff residues and the cleaning liquid.

Figure 5A:
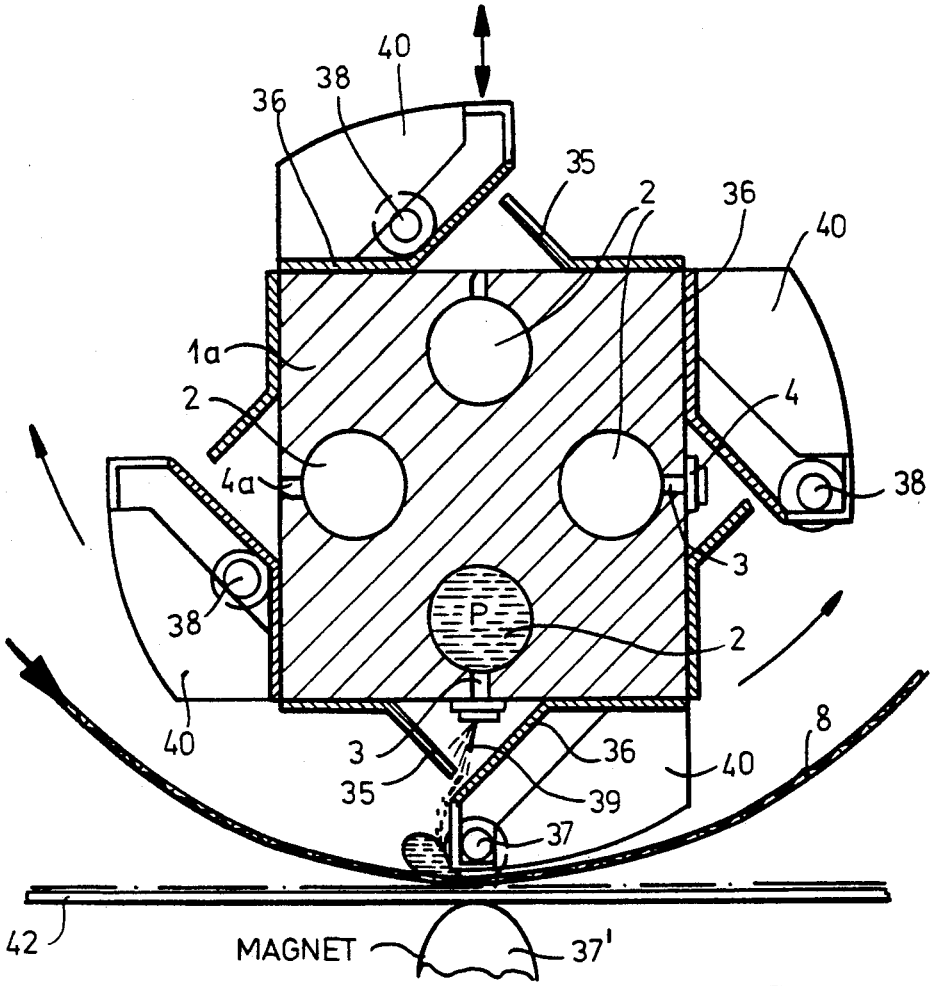
FIGS. 5*a* and 5*b* are views similar to FIGS. 3*a* and 3*b* of an embodiment in which pressing rollers have been substituted for the doctor blades on the applicator body.
Figure 5B:
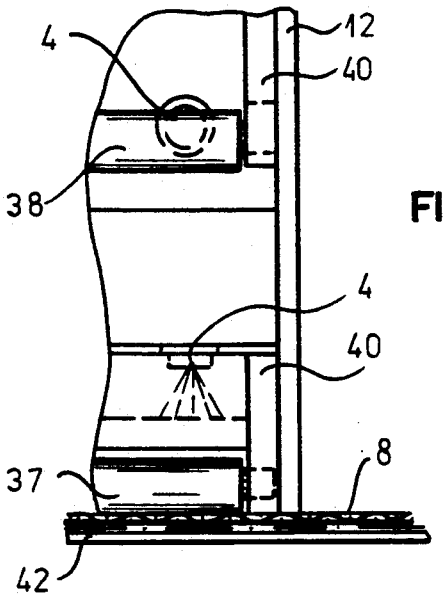

FIGS. 5*a* and 5*b* show an applicator wherein the applicator blades 7 of FIGS. 3*a* and 3*b* are replaced by applicator rollers 37 and 38. The rollers 37 are held somewhat loosely in their respective guides so that a magnet system 37' below the wet, of material to be printed can draw the pressing roller 37 against the inner surface of the template and generate the pressure with which the roller forces the dyestuff through the template and onto the substrate. The magnet system can be located beneath the table 41 along which the fabric substrate is guided.

The diameters of the rollers 37 and 38 can be different.

The applicator body 1*a* is provided here as well with a plurality of medium distribution ducts 2 which are angularly spaced from ore another and supplied form the exterior with the respective dyestuffs. Here the medium is distributed from the spray nozzles 4 in the manner described when the medium in the respective duct is subjected to a pressure above a certain minimum. This pressure is normally adjustable.

Figure 5C:
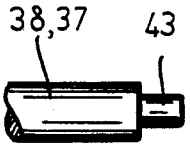
FIG. 5*c* is a detail of one of these rollers.

The medium can be spread by a spreading strip 35, a roller holding bracket 36 on opposite ends of the apparatus supporting the rollers 37 so that they can move upwardly and downwardly along these brackets and thereby be applied by the magnetic force to the screen. The roller holding brackets 36 allow the rollers to be retained in a waiting position as has been shown for the rollers 38 until the rollers are brought into the application station during a color change. To permit the aforementioned movement of the rollers 37 and 38, they may be provided with special end formations 43 as can be seen in FIG. 5*c*, i.e. shaft stubs.

Figure 6A:
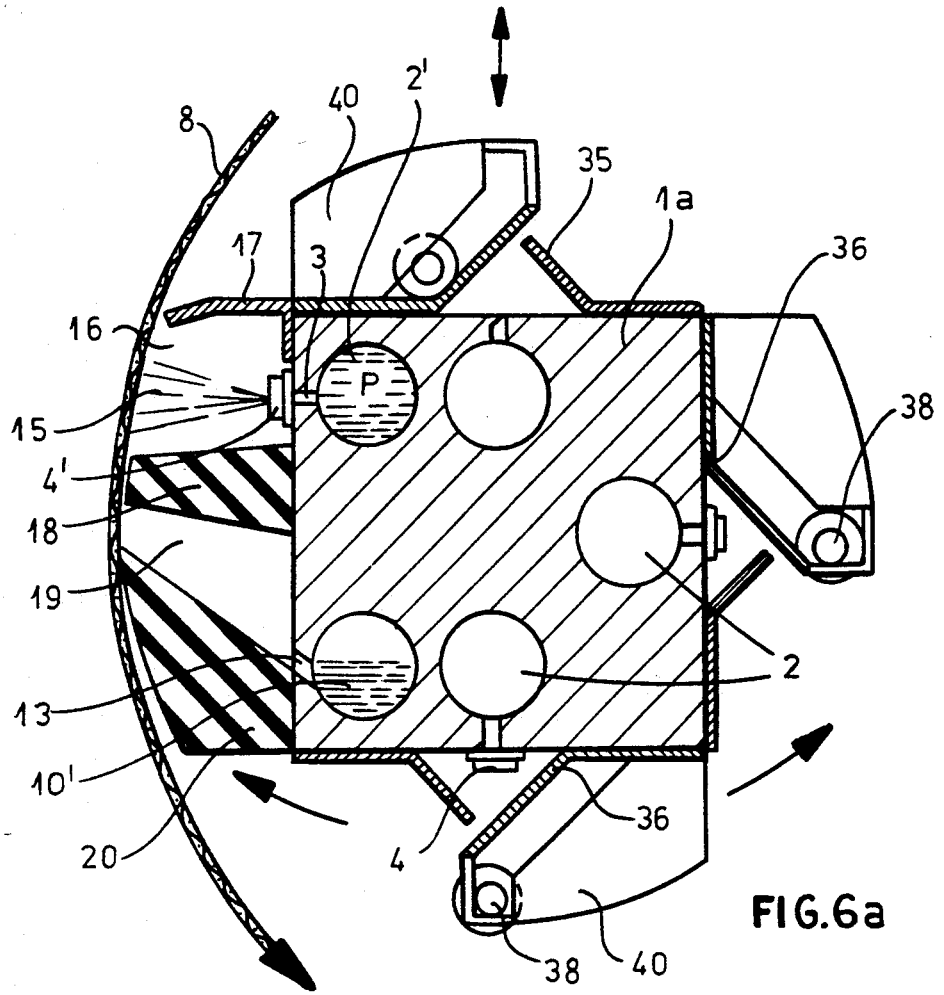
FIG. 6*a* and 6*b* correspond generally to FIGS. 4*a* and 4*b* as applied to an embodiment utilizing rollers like those of FIGS. 5*a* and 5*b*.
Figure 6B:
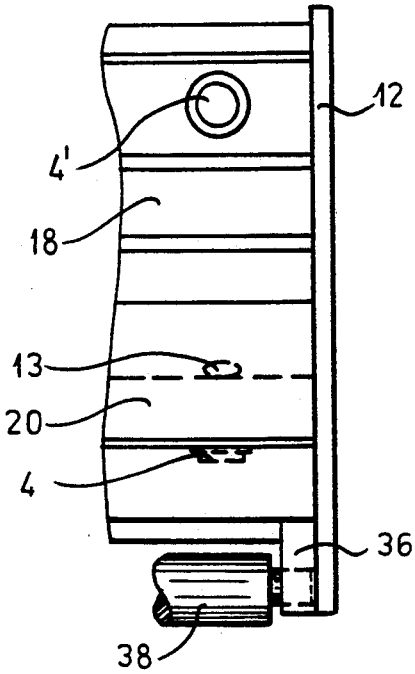

FIG. 6*a* and 6*b* show an applicator of the type otherwise illustrated in FIGS. 5*a* and 5*b*, modified to have the cleaning unit which has been illustrated in FIGS. 4*a* and 4*b*. Since the same reference numerals have been used for corresponding parts in all FIGS., a separate description of this cleaning unit is not necessary.

Figure 7A:
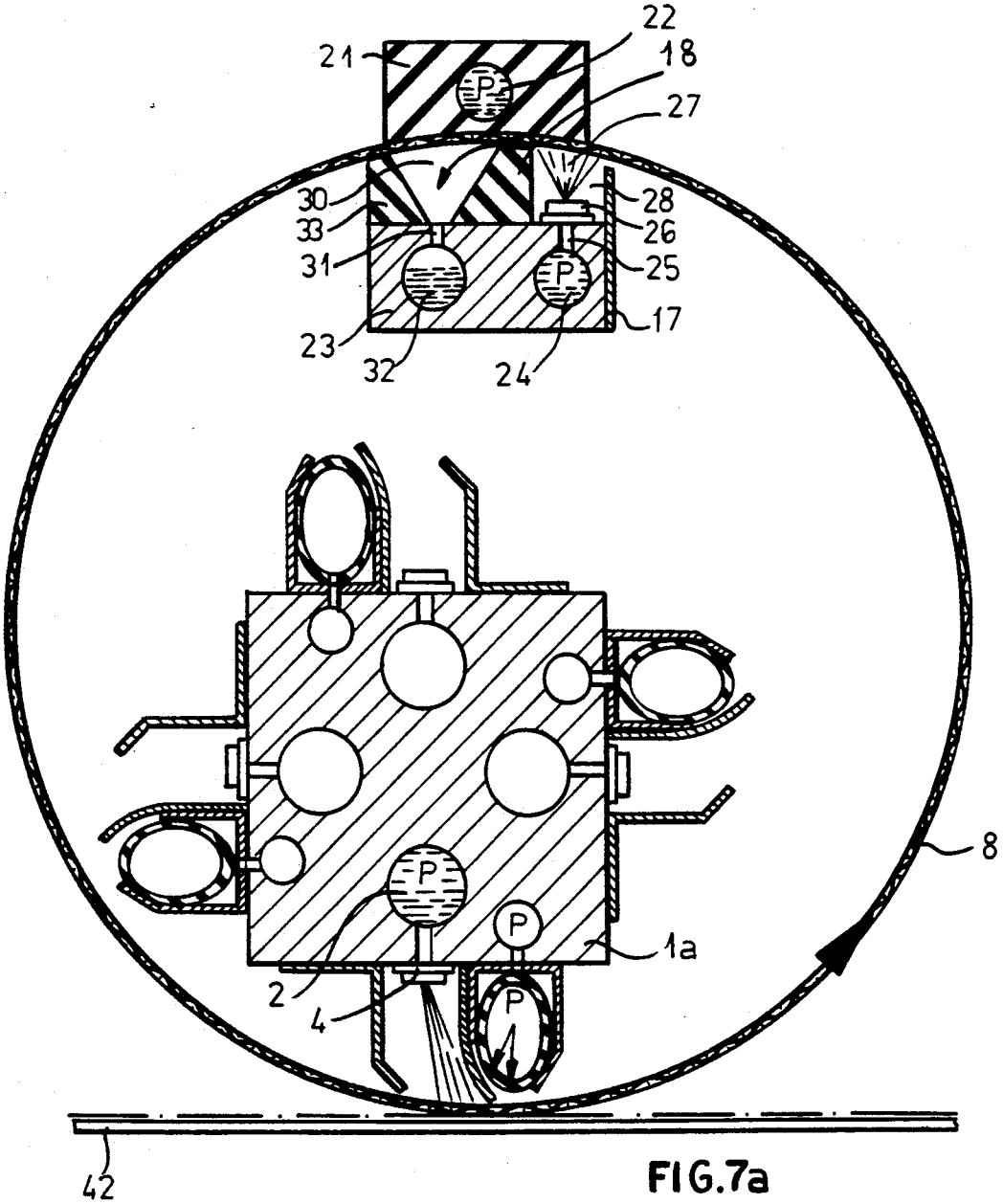
FIGS. 7*a* and 7*b* are further view similar to FIGS. 3*a* and 3*b* showing the apparatus equipped with internal and external cleaning means independent of the applicator.
Figure 7B:
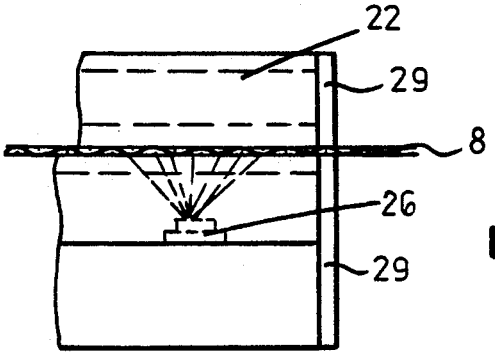
Figure 8A:
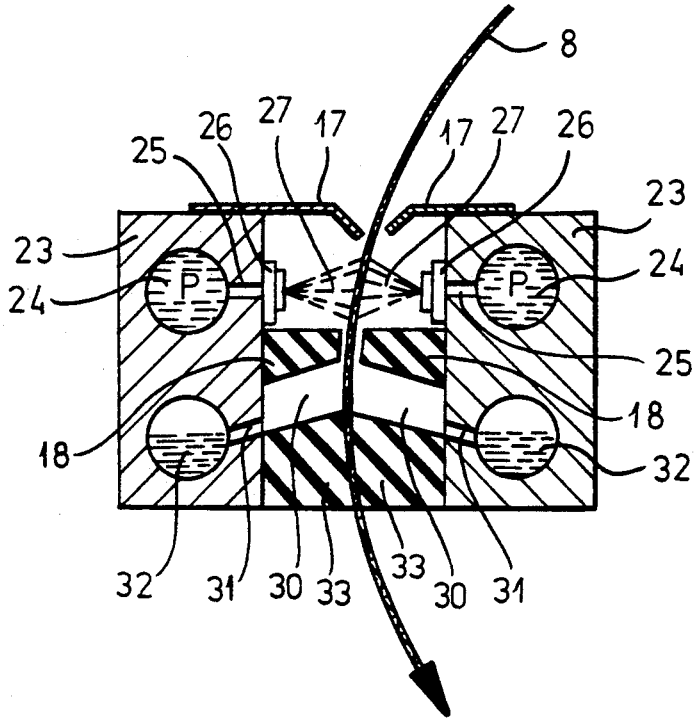
FIGS. 8*a* and 8*b* are, respectively, a fragmentary sectional view and a fragmentary elevational view illustrating variants of the cleaning device of FIGS. 7*a* and 7*b*.
Figure 8B:
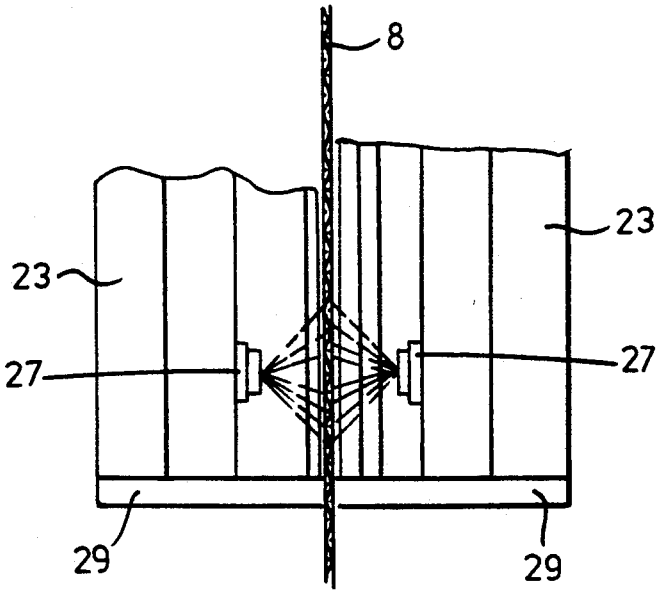
Figure 9:
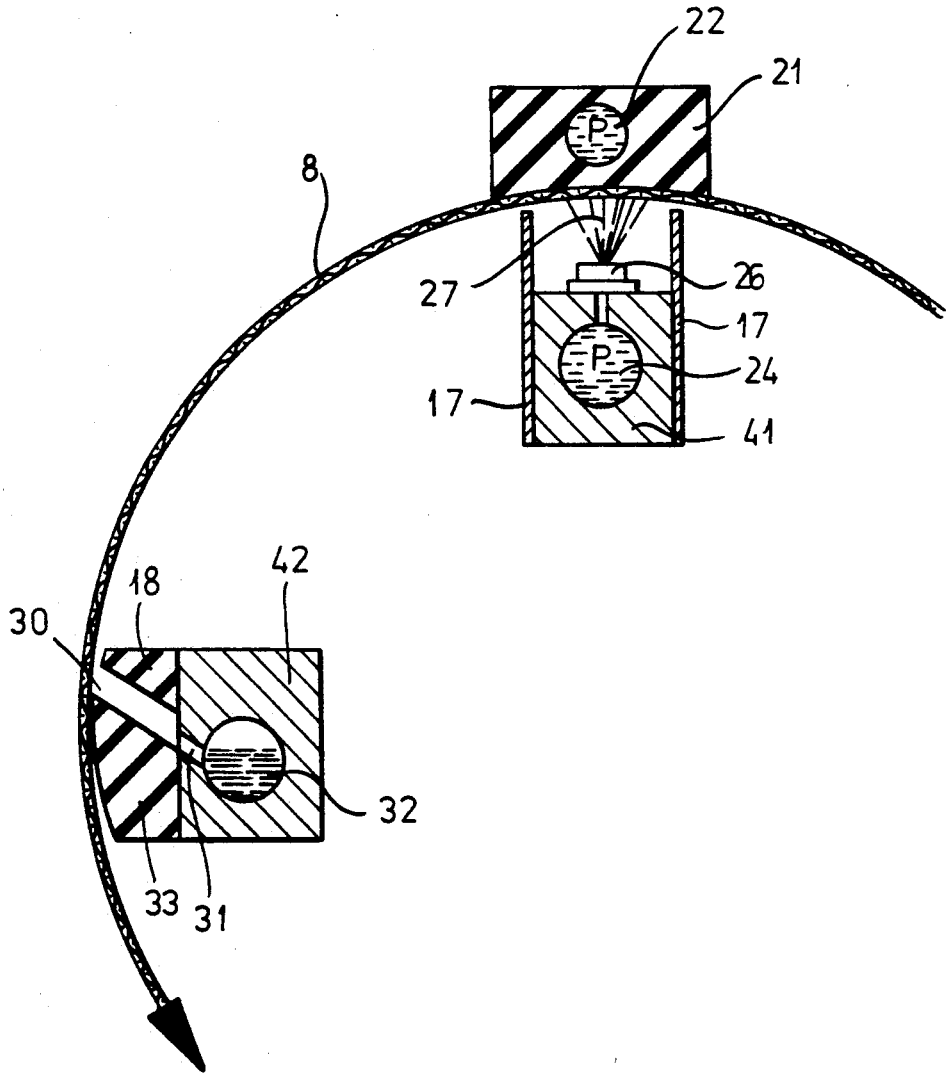
FIG. 9 is a cross sectional view of another cleaning device.

FIGS. 7 through 9 illustrate an additional cleaning device which can be provided, in accordance with the invention, independently of the applicator device.

In a cleaning body 23 (FIG. 7) a cleaning medium distribution duct 24 is provided. This duct 24 has passages 25 supplying spray nozzles or orifices 26. The cleaning medium is supplied from the exterior with a variable pressure and/or volume flow rate. The cleaning medium flows through the duct 24 and passages 25 to the nozzles 26 from which it is sprayed on the inner surface of the screen 8. A moistening body 21, such as a sponge, serves to clean the outer surface of the screen 8 and can be supplied with a cleaning medium 22 from the exterior via a pumping system not shown.

For limiting the dispersal of the cleaning medium to the cleaning compartment 28 and preventing the spray from adversely effecting the remainder of the space within the screen, the cleaning compartment 28 as in the embodiment of FIGS. 4*a* and 4*b*, is defined by a strip 17, the strip 18 and lateral walls 29. The walls 29 are mounted upon the cleaning body 23.

The cleaning medium 27 is collected in a space 30 and carried away by passages 31 and a duct 32 likewise formed in the cleaning body 23 and connected to a reversible dye pump in the manner previously described. The suction compartment 10 is defined between the strip 18 and a squeegee strip 33 between the walls 29.

Of course, the moistening body 21 can be located within the screen drum and the cleaning body 23 and the parts associated therewith can be juxtaposed with the outer surface as is apparent from FIGS. 8*a* and 8*b*, the cleaning system can have, instead of the moistening body 21, two mirror symmetrical units comprised of the parts 17, 18, 23 through 26 and 29 through 33 disposed opposite one another to clean simultaneously the inner and outer surfaces of the pattern drum 8. This embodiment has been found to be especially effective where the drum is difficult to clean.

FIG. 9 illustrates an embodiment generally similar to FIG. 7 except that the cleaning chamber and the suction chamber are spaced apart from one another in separate housing 41 and 42. This can ensure that the residence time of the cleaning medium upon the screen is considerable.

The cleaning devices described are suitable not only for round or drum-type screens or patterns, but also can be used for flat screens or patterns, tables, belts or rollers where mechanical cleaning has not been used heretofore or where in connection with mechanical precleaning or after cleaning, an improved cleaning effect is desired.

Further improvement in the cleaning results can be obtained by providing a number of cleaning units as described one after another along the path of the screen.

Figure 10:
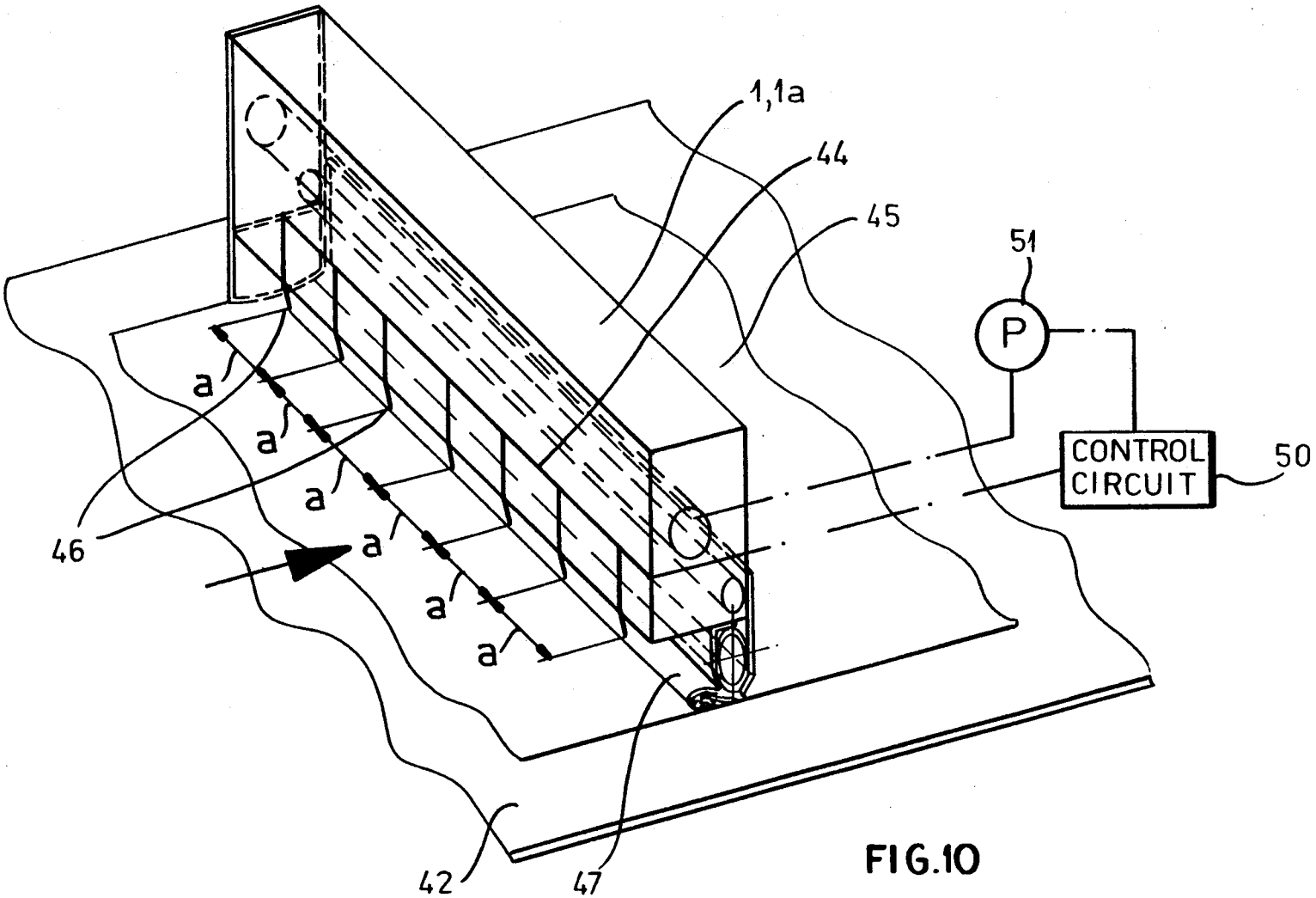
FIG. 10 is a perspective view diagrammatically illustrating the provision of a plurality of level sensors adjustably spaced apart the full working width for measuring the level at these locations of the bank of the liquid medium.

In FIG. 10 we have shown a multiplicity of level detectors 46 spaced apart by the distance 1 from one another on the applicator body 1, 1*a* to measure the depth of the bank 47 of the flowable medium upstream of the applicator roller or blade over the full working width of the machine. The spacing a can be selected freely and will be chosen in accordance with the desired degree of uniformity of screen printing of the fabric 45 to be printed. The individual sensors 46 are connected by conductors or bus bars 44 to the control circuitry 50 which can operator a variable displacement pump 51 supplying the respective fluid medium distribution duct, thereby controlling the dyestuff supply.

We claim:

1. An apparatus for applying a flowable medium to a receiving surface, comprising:

means for relatively displacing said receiving surface and a station at which said flowable medium is applied to said surface;

an elongated applicator body at said station having an axis parallel to said surface and formed with:

a plurality of medium-supply vessels containing different flowable mediums applicable to said surface, a plurality of medium-distribution ducts each connectable to a respective one of said medium-supply vessels, and respective outlet openings connected to each of said ducts and extending along said body, the outlet openings connected to each duct being angularly spaced about said axis from the openings connected to the others of said ducts;

means for mounting said body for rotation about said axis for selectively positioning the openings connected to a respective one of said ducts in juxtaposition with said surface so that only a flowable medium from said one of said ducts is applied to said surface and the different flowable medium can be selectively applied to said surface by rotation of said body about said axis;

at least one applicator blade disposed along said body on a downstream side of the openings juxtaposed with said surface with respect to a direction of relative displacement of said station and said surface for wiping a fluid medium to be applied onto said surface;

a dilatable support element extending along said body adjacent said applicator blade and against which said applicator blade is braced;

means connected with said dilatable support element for controlling pressure and volume thereof;

a strip extending along said body at an upstream side of the openings juxtaposed with said surface with respect to said direction for defining with said blade an applicator compartment into which a flowable medium is discharged, said applicator compartment being formed with a first and second end opposite one another; and lateral wall means for closing opposite ends of said compartment; and a screen defining a pattern of medium application of said surface interposed between said surface and said body.

2. The apparatus defined in claim 1 wherein said blade, said support element, said strip and said wall means are provided on said body.

3. The apparatus defined in claim 2 wherein a respective said compartment is defined on said body by a respective said support element, said strip and said wall means for the openings connected to each of said ducts.

4. The apparatus defined in claim 1 wherein at least one of said ducts is formed with a self-priming reversible dye pump having means for controlling volume rate of flow of a fluid medium pumped therethrough.

5. The apparatus defined in claim 1, further comprising means for adjusting a width of application of a flowable medium to said surface.

6. The apparatus defined in claim 1, further comprising a multiplicity of level sensors spaced apart across a full width of application of a flowable medium to said surface and responsive to a depth of a bank of the flowable medium being applied to said surface for controlling flow thereof to the respective duct, said level sensors having a mutually adjustable spacing from one another.

7. The apparatus defined in claim 6 wherein said sensors are connected to a control circuit controlling said apparatus to maintain a uniform application of a flowable medium to said surface.

8. The apparatus defined in claim 1 wherein said surface is a web of a flexible material and flowable medium is a coloring substance.

9. The apparatus defined in claim 1 wherein at least one of said ducts is formed with a self-priming reversible dye pump having means for controlling pressure of a fluid medium pumped therethrough.

10. An apparatus for applying a flowable medium to a receiving surface, comprising:

means for relatively displacing said receiving surface and a station at which said flowable medium is applied to said surface;

an elongated applicator body at said station having an axis parallel to said surface and formed with:

a plurality of medium-supply vessels containing different flowable mediums applicable to said surface, a plurality of medium-distribution ducts each connectable to a respective one of said medium-supply vessels, respective outlet openings connected to each of said ducts and extending along said body, the outlet openings connected to each duct being angularly spaced about said axis from the openings connected to the others of said ducts, respective guides disposed along said body and entrained with said body upon rotation thereof to position said outlet openings connected to one of said ducts in juxtaposition with said surface, said guides being assigned to the respective outlet openings, and respective applicator rollers having formations at opposite ends of said rollers received in said guides and extending a full width of application of a flowable medium to said surface for rolling a respective medium onto said surface upon positioning of openings connected to one of said ducts in juxtaposition with said surface by rotation of said body about said axis;

means for mounting said body for rotation about said axis for selectively positioning the openings connected to a respective one of said ducts in juxtaposition with said surface so that only a flowable medium from said one of said ducts is applied to said surface and the different flowable medium can be selectively applied to said surface by rotation of said body about said axis; and a screen defining a pattern of medium application to said surface interposed between said surface and said body.

11. An apparatus for applying a flowable medium to a receiving surface, comprising:

means for relatively displacing said receiving surface and a station at which said flowable medium is applied to said surface;

an elongated applicator body at said station having an axis parallel to said surface and formed with:

a plurality of medium-supply vessels containing different flowable mediums applicable to said surface, a plurality of medium-distribution ducts each connectable to a respective one of said medium-supply vessels, and respective outlet openings connected to each of said ducts and extending along said body, the outlet openings connected to each duct being angularly spaced about said axis from the openings connected to the others of said ducts, said outlet openings being spray nozzles trained toward said surfaces and provided with pressure-actuated valves automatically closing upon a pressure drop below a predetermined pressure upstream of said nozzles;

means for mounting said body for rotation about said axis for selectively positioning the openings connected to a respective one of said ducts in juxtaposition with said surface so that only a flowable medium from said one of said ducts is applied to said surface and the different flowable mediums can be selectively applied to said surface by rotation of said body about said axis; and a screen defining a pattern of medium application of said surface interposed between said surface and said body.

12. An apparatus for applying a flowable medium to a receiving surface, comprising:

means for relatively displacing said receiving surface and a station at which said flowable medium is applied to said surface;

an elongated applicator body at said station having an axis parallel to said surface and formed with:

a plurality of medium-supply vessels containing different flowable mediums applicable to said surface, a plurality of medium-distribution ducts each connectable to a respective one of said medium-supply vessels, and respective outlet openings connected to said ducts and extending along said body, the outlet openings connected to each duct being angularly spaced about said axis from the openings connected to the others of said ducts;

means for mounting said body for rotation about said axis for selectively positioning the openings connected to a respective one of said ducts in juxtaposition with said surface so that only a flowable medium from said one of said ducts is applied to said surface and the different flowable mediums can be selectively applied to said surface by rotation of said body about said axis; and a screen defining a pattern of medium application to said surface interposed between said surface and said body; and means for feeding a cleaning liquid through said outlet openings, said feeding means being connected to at least one of said ducts for cleaning said screen, said body further comprising means forming a passage for carrying cleaning fluid away from said screen.

13. The apparatus defined in claim 12, further comprising means for cleaning internal and external surfaces of said screen from a flowable medium previously applied to said surface.

14. An apparatus for applying a flowable medium to a receiving surface, comprising:

means for relatively displacing said receiving surface and a station at which said flowable medium is applied to said surface;

an elongated applicator body at said station having an axis parallel to said surface and formed with:

a plurality of medium-supply vessels containing different flowable mediums applicable to said surface, a plurality of medium-distribution ducts each connectable to a respective one of said medium-supply vessels, and respective outlet openings connected to each of said ducts and extending along said body, the outlet openings connected to each duct being angularly spaced about said axis from the openings connected to the others of said ducts;

means for mounting said body for rotation about said axis for selectively positioning the openings connected to a respective one of said ducts in juxtaposition with said surface so that only a flowable medium from said one of said ducts is applied to said surface and the different flowable mediums can be selectively applied to said surface by rotation of said body about said axis; and a screen defining a pattern of medium application to said surface interposed between said surface and said body; and means for cleaning internal and external surfaces of said screen from a flowable medium previously applied to said surface.

15. An apparatus for applying a flowable medium to a receiving surface, comprising:

means for relatively displacing said receiving surface and a station at which said flowable medium is applied to said surface;

an elongated applicator body at said station having an axis parallel to said surface and formed with:

a plurality of medium-supply vessels containing different flowable mediums applicable to said surface, a plurality of medium-distribution ducts each connectable to a respective one of said medium-supply vessels, and respective outlet openings connected to each of said ducts and extending along said body, the outlet openings connected to each duct being angularly spaced about said axis from the openings connected to the others of said ducts;

means for mounting said body for rotation about said axis for selectively positioning the openings connected to a respective one of said ducts in juxtaposition with said surface so that only a flowable medium from said one of said ducts is applied to said surface and the different flowable mediums can be selectively applied to said surface by rotation of said body about said axis;

a screen defining a pattern for medium application to said surface interposed between said surface and said body; and means for adjusting a width of application of a cleaning medium to said screen.

16. The apparatus defined in claim 15 wherein said means for adjusting comprises a replaceable preformed applicator strip adapted to be pressed against said screen.

* * * * *